US011453524B1

(12) United States Patent
Baryshyan

(10) Patent No.: US 11,453,524 B1
(45) Date of Patent: Sep. 27, 2022

(54) BAKERY BOX CLIPS

(71) Applicant: FC Meyer Packaging LLC, Norwalk, CT (US)

(72) Inventor: Matthew Arthur Baryshyan, Stormville, NY (US)

(73) Assignee: FC Meyer Packaging LLC, Norwalk, CT (US)

( * ) Notice: Subject to any disclaimer, the term of this patent is extended or adjusted under 35 U.S.C. 154(b) by 0 days.

(21) Appl. No.: 17/332,406

(22) Filed: May 27, 2021

(51) Int. Cl.
*B65D 5/20* (2006.01)
*B65D 5/42* (2006.01)
*B65D 85/36* (2006.01)

(52) U.S. Cl.
CPC ..... *B65D 5/2057* (2013.01); *B65D 5/4204* (2013.01); *B65D 85/36* (2013.01)

(58) Field of Classification Search
CPC .... B65D 5/302; B65D 5/6658; B65D 5/6664; B65D 5/2052–2061
USPC ..... 229/141, 149, 150, 152–158, 195–197
See application file for complete search history.

(56) References Cited

U.S. PATENT DOCUMENTS 2,475,279 A * 7/1949 Dunning ..... B65D 5/6664 229/149
3,137,435 A * 6/1964 Meyers ..... B65D 5/4204 229/113
3,165,253 A * 1/1965 Adams ..... B65D 5/302 229/150
4,097,611 A * 6/1978 Seiferth ..... B65D 5/4295 426/121

FOREIGN PATENT DOCUMENTS

DE 1118094 B * 11/1961 ..... B65D 5/302
GB 837482 A * 6/1960 ..... B65D 5/302
GB 946117 A * 1/1964 ..... B65D 5/2057

* cited by examiner

*Primary Examiner* — Nathan J Newhouse
*Assistant Examiner* — Phillip D Schmidt
(74) *Attorney, Agent, or Firm* — Hess Patent Law Firm; Robert J. Hess

(57) ABSTRACT

A bakery box having panels, flaps, tabs and slits. One each side of the box, a pair of the tabs are inserted into a pair of the slits in a corresponding side panel of the box. One tab of the pair of tabs on each side of the box has a curved slit into which is inserted a curved edge of a corresponding side flap to retain the side flap adjacent the corresponding side panel of the box.

12 Claims, 3 Drawing Sheets

BAKERY BOX CLIPS

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

(1) Field of the Invention

The invention relates to an unglued box used for food service and bakery applications that is equipped with an integrally formed clip to retain lid flaps in position adjacent to sides of the box.

(2) Description of Related Art

Most unglued boxes that are used for food service and bakery applications are constructed using a lock corner style that has three panels that need to be closed. The front panel normally has either a tuck tab or a cereal box style lock. This panel is normally 1" in depth.

The side panels, because they are the full depth of the box, which could be as much as 6", need to have the side panels secured. Typically, some people use the traditional baker's twine to close the panels—nostalgic, but expensive and time consuming. The next method is to tape the panels closed, which does not address the issue of reclosure. Finally, and the worse option to close the box, is to tuck the side flaps into the box itself which invariably causes the icing to be damaged.

It is therefore desired to build a better box for the bakery market, which is growing with small bistro bakeries, in-house coffee shop bakeries and home bakers who are baking cakes, cookies and brownies for church and social functions, have all expressed a need for an integrated reclosure for their bakery box.

SUMMARY OF THE INVENTION

One aspect of the invention is to provide integrated side panel box clips that utilize die cut elliptical cuts on the front corner lock panels to hold down the side flaps of the box.

This integrated simple feature eliminated the need for box string, tape or tucking in the flaps.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
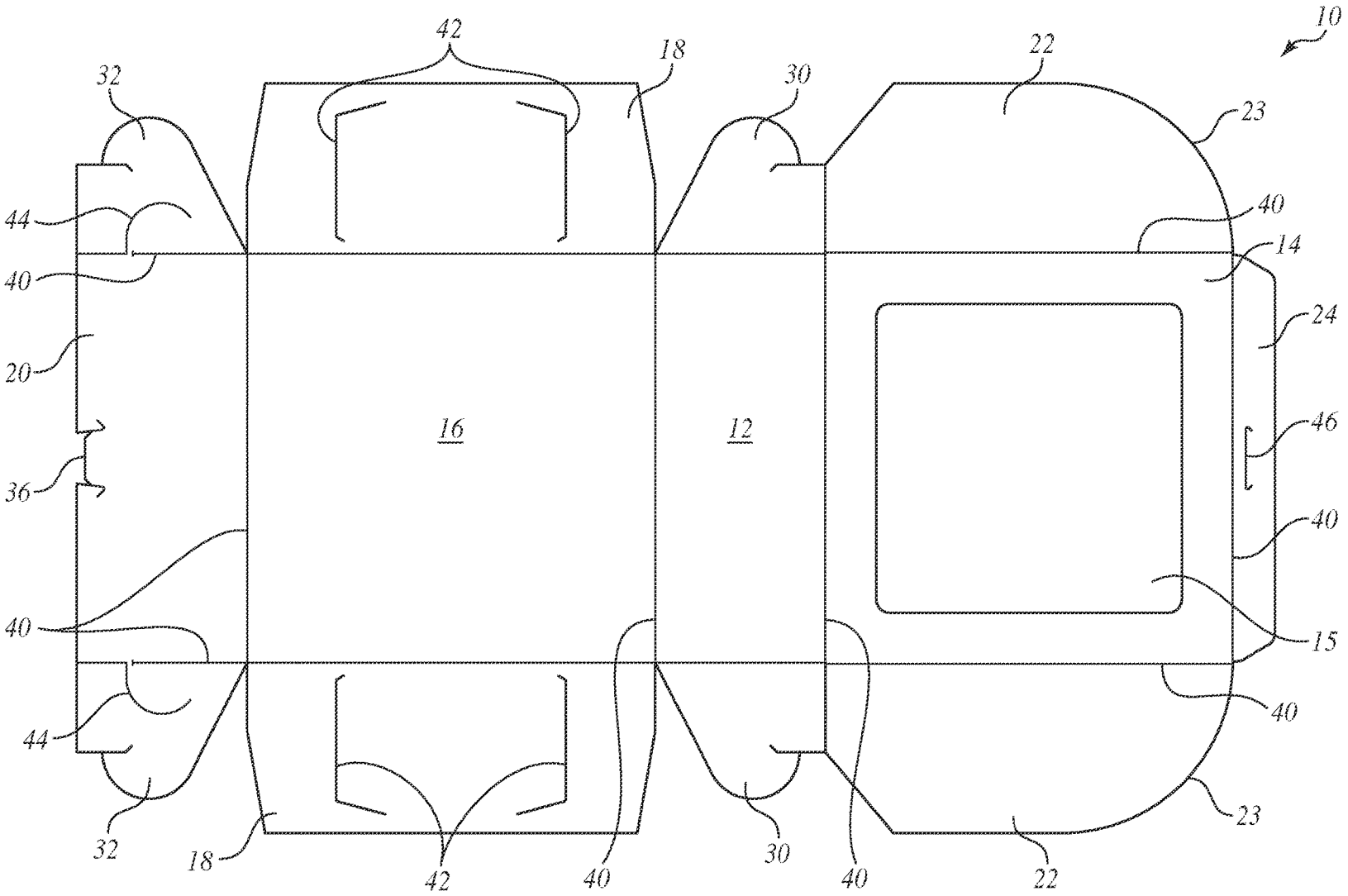
FIG. 1 is a top view of a box blank in a flattened condition accordance with the invention.

Turning to FIG. 1, a box blank 10 is depicted that when folded into a box shape can serve as a bakery food container such as to contain a cake or pastries. The box blank 10 has panels, flaps, tabs and slits. Preferably, the box blank is made of paperboard or boxboard. Paperboard or boxboard is thicker than average paper, but it is still just one layer. In contrast, cardboard is three layers of heavy paper, two flat with a wavy one in the middle. Further, cardboard is ribbed and has a honeycombed pattern of air pockets when viewed from the side, paperboard or boxboard is usually thinner, and has no honeycombed air pockets or ribs.

The panels include a back panel 12, a lid panel 14, a base panel 16 and two side panels 18. The back panel 14 separates the lid panel 14 from the base panel 16. The two side panels 18 are separated from each other by the base panel 16 and including a front panel 20. The flaps include two side flaps 22 separated from each other by the lid panel 14 and include a lid flap 24. The plurality of tabs also include two back side tabs 30 and two front side tabs 32. If desired, the lid panel 14 may have a window opening 15 that is to be closed in a conventional manner with a transparent plastic film underlay adhered to the inside facing surface of the rim of the lid panel 14 that borders the window opening 15. The window opening 15 may be within a rectangular border formed by inner facing edges of the lid panel 14.

The plurality of creases 40 include respective ones of the creases 40 arranged between the back panel 12 and each of the top and base panels 14, 16, between the base panel 16 and each of the two side panels 18, between the base panel 16 and the front panel 20, between the lid panel 14 and each of the two side flaps 22, between the lid flap 24 and the lid panel 14, between the back panel 12 and each of the two back side tabs 30, and between the front panel 20 and each of the two front side tabs 32.

The two side panels 18 each have a respective pair of the slits 42. The two front side tabs 32 each have a respective one of the slits 44.

One of the front panel 20 and the lid flap 24 has a further respective one of the slits 46 and the other of the front panel 20 and the lid flap 24 has one front tab 36.

Figure 2:
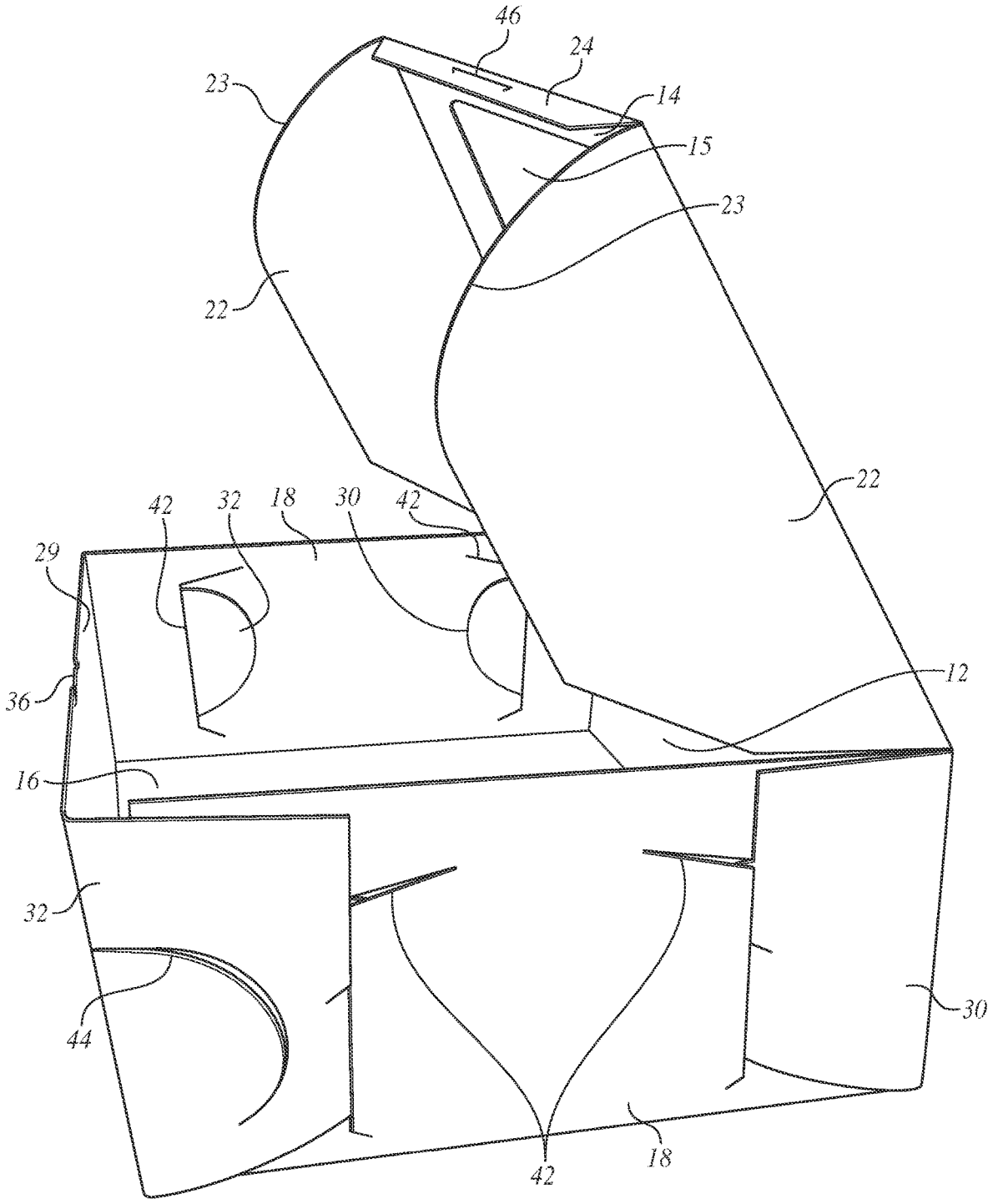
FIG. 2 is an isometric view of the top, side and rear of the box that was folded from the flattened condition of FIG. 1.

By folding the box blank of FIG. 1 along its creases in a conventional manner for conventional bakery boxes, the folded condition of FIG. 2 ensues for the bakery box. In the folded condition, the box can accommodate a cake or pastries or other bakery items or foods.

That is, the folding of the box along the creases causes the panels to form a box shape. To remain in the box shape on its own, the two back side tabs 30 and the two front side tabs 32 are inserted into the respective pair of the slits 42 of corresponding ones of the two side panels 18. The respective pair of the slits 42 in each of the two side panels 18 configured and arranged symmetric with one another relative to a centerline (not shown) passing in a widthwise direction of the two side panels 18.

To keep the front of the box closed, the one front tab 36 of the front panel 20 is inserted into the further respective one of the slits 46 of the lid flap 24. Such may be considered the front locks.

The slits 42 of the two front side tabs 32 have curvature and extend from the crease 40 between the side flap 22 and the front panel 20. The two side flaps 22 each have a curved corner edge 23.

To keep the two side flaps 22 in a closed condition adjacent the two side panels 18, the curved corner edge 23 of each of the two side flaps 22 is inserted into respective ones of the slits 42 of the two front side tabs 32. In effect, the two front side tabs 32 serve as a clip to retain the two side flaps 22 because of their slits 42—into which is inserted the curved corner edge 23 of the two side flaps 22.

Figure 3:
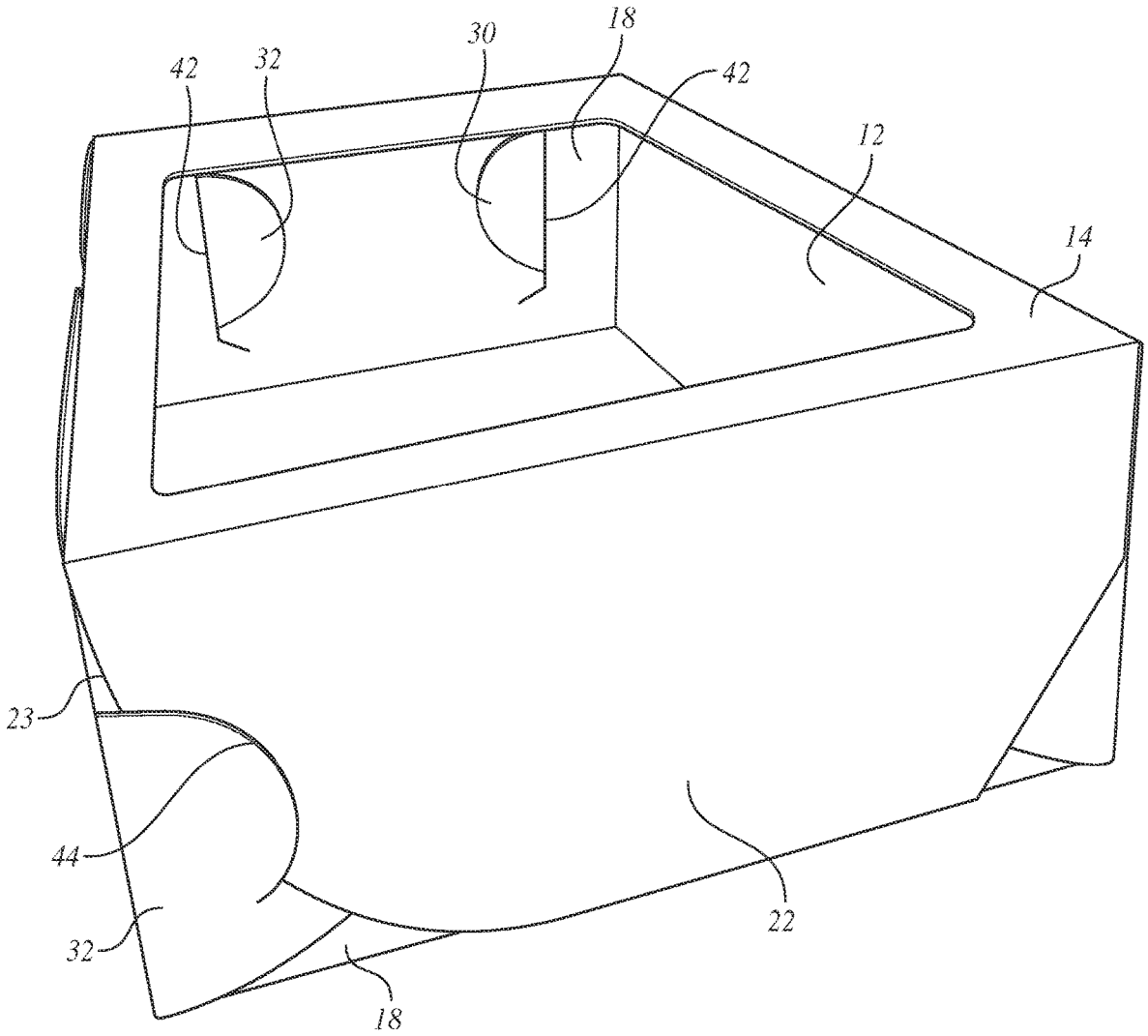
FIG. 3 is an isometric view of the clip of the box.

As can be appreciated from FIG. 3, the two front side tabs 32 hold down the two side flaps 22 of the box so one doesn't need to tie or use stickers to hold the side flaps 22 down. The two front side tabs 32 are located away from the front locks, which arrangement does not deter from the box's strength.

The manner of use of the box in its folded condition involves four steps:

Step 1. Lock the two back corners;

Step 2. Slide in the cake;

Step 3. Close the front locks;

Step 4. Bring down the lid panel and slide the front corner of the lid into the clips and lock the lid into the center lid lock. The box is now closed on all sides securely.

The box is not damaged and is ready for reclosure as needed. The cake is not damaged by tucking the box into the interior.

While the foregoing description and drawings represent the preferred embodiments of the present invention, it will be understood that various changes and modifications may be made without departing from the scope of the present invention.

What is claimed is:

1. A box blank foldable into a box shape, comprising: panels, flaps, tabs, creases and slits, wherein the panels include a front panel, a back panel, a lid panel, a base panel and two side panels, the back panel separating the lid panel from the base panel, the base panel separating the two side panels from each other; the flaps include two side flaps separated from each other by the lid panel and include a lid flap; the tabs include two back side tabs and two front side tabs; the creases include respective ones of the creases arranged between the back panel and each of the top and base panels, between the base panel and each of the two side panels, between the lid panel and each of the two side flaps, between the lid flap and the lid panel, between the front panel and the base panel, between the back panel and each of the two back side tabs, and between the front panel and each of the two front side tabs; and the slits include a respective pair of the slits in each of the two side panels, the slits also include two slits in the two front side tabs respectively that extend from a corresponding one of the creases that are between the front panel and the two front side tabs, wherein the panels, flaps, tabs, creases and slits are arranged so as to form a box shape upon folding appropriately along each of the creases and inserting the tabs into neighboring ones of the slits and inserting respective ones of edges of the two side flaps into respective ones of the slits of the two front side tabs.

2. The box blank of claim 1, wherein the respective pair of the slits in each of the two side panels being configured to be symmetric with one another.

3. The box blank of claim 1, wherein the slits in the front side tabs each has curvature and the respective edge of each of the two side flaps has curvature.

4. The box blank of claim 1, wherein the front panel and the lid flap are connectable to each other via engagement of a slit in the lid flap and a tab of the front panel after the panels are folded to form the box shape.

5. The box blank of claim 1, wherein the panels, the flaps and the tabs are all of paperboard material.

6. The box blank of claim 1, wherein the lid panel defines an opening bounded by an inner facing edge of the lid panel.

7. A box assembly, comprising: panels, flaps, tabs, creases and slits, wherein: the panels include a front panel, a side panel and a further side panel that together constitute two side panels, a back panel, a base panel, and a lid panel, the back panel separating the lid panel from the base panel, the base panel separating the two side panels from each other; the flaps include two side flaps and include a lid flap, the two side flaps being separated from each other by the lid panel; the tabs include two back side tabs and include two front side tabs; the creases include respective ones of the creases arranged between the back panel and each of the top and base panels, between the base panel and each of the two side panels, between the lid panel and each of the two side flaps, between the lid flap and the lid panel, between the front panel and the base panel, between the back panel and each of the two back side tabs, and between the front panel and each of the two front side tabs; and the slits include a respective pair of the slits in each of the two side panels, the slits also include two slits in the two front side tabs that extend from a corresponding one of the creases that are between the front panel and each of the two front side tabs wherein each of the creases are folded so that the panels form a box shape, the two back side tabs and the two front side tabs being inserted into the respective pair of the slits of the two side panels, the two side flaps each having a respective edge inserted into a respective one of the slits of the two front side tabs.

8. The box of claim 7, wherein the respective pair of the slits in each of the two side panels being configured to be symmetric with one another.

9. The box of claim 7, wherein the respective one of the slits in each of the front side tabs has curvature and the respective edge of each of the two side flaps has curvature.

10. The box of claim 7, wherein the front panel and the lid flap connect with each other via engagement of a slit in the lid flap with a tab of the front panel.

11. The box of claim 7, wherein the panels, the flaps and the tabs are all of paperboard material.

12. The box of claim 7, wherein the lid panel defines an opening bounded by an inner facing edge of the lip panel.

* * * * *